US011605394B2

(12) United States Patent
Liang

(10) Patent No.: US 11,605,394 B2
(45) **Date of Patent: *Mar. 14, 2023**

(54) SPEECH SIGNAL CASCADE PROCESSING METHOD, TERMINAL, AND COMPUTER-READABLE STORAGE MEDIUM

(71) Applicant: Tencent Technology (Shenzhen) Company Limited, Shenzhen (CN)

(72) Inventor: Junbin Liang, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 155 days.

This patent is subject to a terminal disclaimer.

(21) Appl. No.: 17/076,656

(22) Filed: Oct. 21, 2020

(65) Prior Publication Data

US 2021/0035596 A1 Feb. 4, 2021

Related U.S. Application Data

(63) Continuation of application No. 16/001,736, filed on Jun. 6, 2018, now Pat. No. 10,832,696, which is a (Continued)

(30) Foreign Application Priority Data

Apr. 15, 2016 (CN) ..... 201610235392.9

(51) Int. Cl.
*G10L 21/0364* (2013.01)
*G10L 19/26* (2013.01)

(Continued)

(52) U.S. Cl.
CPC ..... *G10L 21/0364* (2013.01); *G10L 19/02* (2013.01); *G10L 19/26* (2013.01);

(Continued)

(58) Field of Classification Search
CPC ..... G10L 21/0364; G10L 19/02; G10L 19/26; G10L 25/51; G10L 25/90; G10L 21/02;

(Continued)

(56) References Cited

U.S. PATENT DOCUMENTS 5,012,518 A 4/1991 Liu et al.
5,657,422 A * 8/1997 Janiszewski ..... G10L 19/135 704/229

(Continued)

FOREIGN PATENT DOCUMENTS

CN 1285945 A 2/2001
CN 1971711 A 5/2007

(Continued)

OTHER PUBLICATIONS

Tencent Technology, ISRWO, PCT/CN2017/076653, dated May 31, 2017, 8 pgs.

(Continued)

*Primary Examiner* — Huyen X Vo
(74) *Attorney, Agent, or Firm* — Morgan, Lewis & Bockius LLP

(57) ABSTRACT

A method for improving speech signal intelligibility is performed at a device. A speech signal is obtained. A correspondence between the speech signal and a respective user group among different user groups having distinct voice characteristics is identified. Pre-encoding signal augmentation is performed on the speech signal with a respective pre-augmentation filtering coefficient that corresponds to the respective user group to obtain a group-specific pre-augmented speech signal. The device encodes the pre-augmented speech signal for subsequent transmission through the voice communication channel. An encoded version of the pre-augmented speech signal has reduced loss of signal quality as compared to an encoded version of the speech (Continued)

signal that is obtained without the pre-encoding signal augmentation.

18 Claims, 12 Drawing Sheets

Related U.S. Application Data continuation-in-part of application No. PCT/CN2017/076653, filed on Mar. 14, 2017.

(51) Int. Cl.

| | |
|---|---|
| ***G10L 25/51*** | (2013.01) |
| ***G10L 19/02*** | (2013.01) |
| ***G10L 25/90*** | (2013.01) |
| *G10L 25/21* | (2013.01) |
| *G10L 25/06* | (2013.01) |
| *G10L 21/02* | (2013.01) |
| *G10L 25/09* | (2013.01) |
| *G10L 25/78* | (2013.01) |

(52) U.S. Cl.

CPC ..... *G10L 25/51* (2013.01); *G10L 25/90* (2013.01); *G10L 21/02* (2013.01); *G10L 25/06* (2013.01); *G10L 25/09* (2013.01); *G10L 25/21* (2013.01); *G10L 25/78* (2013.01)

(58) Field of Classification Search

CPC ..... G10L 25/06; G10L 25/09; G10L 25/21; G10L 25/78; G10L 21/0232; G10L 21/0324; H04B 3/20; H04M 9/08; H04M 9/10

See application file for complete search history.

(56) References Cited

U.S. PATENT DOCUMENTS

| | | | | |
|---|---|---|---|---|
| 6,104,991 | A * | 8/2000 | Newland | G10L 19/0204 704/212 |
| 8,160,877 | B1 * | 4/2012 | Nucci | G10L 17/06 704/247 |
| 8,831,942 | B1 * | 9/2014 | Nucci | G10L 25/90 704/250 |
| 9,330,684 | B1 | 5/2016 | Kirsch | |
| 2006/0095256 | A1 | 5/2006 | Nongpiur et al. | |
| 2011/0153317 | A1 | 6/2011 | Mao et al. | |
| 2013/0166288 | A1 | 6/2013 | Gao et al. | |

FOREIGN PATENT DOCUMENTS

| | | | |
|---|---|---|---|
| CN | 102779527 | A | 11/2012 |
| CN | 103413553 | A | 11/2013 |
| CN | 104269177 | A | 1/2015 |
| CN | 105913854 | A | 8/2016 |
| EP | 0929065 | A2 | 7/1999 |
| WO | WO 2004097799 | A1 | 11/2004 |

OTHER PUBLICATIONS

Tencent Technology, IPRP, PCT/CN2017/076653, dated Oct. 16, 2018, 6 pgs.

Ma Xiao-min et al., "Implementation of Pitch Detection Based on ACF by MATLAB", Journal of Northwest University for Nationalities (Natural Science), vol. 31, No. 4, pp. 54-56, Dec. 2010.

* cited by examiner

SPEECH SIGNAL CASCADE PROCESSING METHOD, TERMINAL, AND COMPUTER-READABLE STORAGE MEDIUM

CROSS-REFERENCE TO RELATED APPLICATIONS

This application is a continuation of U.S. patent application Ser. No. 16/001,736, entitled "SPEECH SIGNAL CASCADE PROCESSING METHOD AND APPARATUS", filed Jun. 6, 2018, which is a continuation-in-part of PCT/CN2017/076653, entitled "SPEECH SIGNAL CASCADE PROCESSING METHOD AND APPARATUS", filed Mar. 14, 2017, which claims priority to Chinese Patent Application No. 201610235392.9, entitled "SPEECH SIGNAL CASCADE PROCESSING METHOD AND APPARATUS" filed with the Patent Office of China on Apr. 15, 2016, all of which are incorporated by reference in their entirety.

FIELD OF THE TECHNOLOGY

The present disclosure relates to the field of audio data processing, and in particular, to a speech signal cascade processing method, a terminal, and a non-volatile a computer-readable storage medium.

BACKGROUND OF THE DISCLOSURE

With popularization of Voice over Internet Protocol (VoIP) services, an increasing quantity of applications are mutually integrated between different networks. For example, an IP phone over the Internet is interworked with a fixed-line phone over a Public Switched Telephone Network (PSTN), or the IP phone is interworked with a mobile phone of a wireless network. Different speech encoding/decoding formats are used for speech inputs of different networks. For example, AMR-NB encoding is used for a wireless Global System for Mobile Communications (GSM) network, G711 encoding is used for a fixed-line phone, and G729 encoding or the like is used for an IP phone. Because speech formats supported by respective network terminals are inconsistent, multiple encoding/decoding processes are inevitably required on a call link, and an objective of the encoding/decoding processes is enabling terminals of different networks and device formats to be able to work together and support cross-network and cross-platform voice communications after the cascade encoding/decoding performed on the input audio signals. However, most currently used speech encoders are lossy encoders. That is, each encoding/decoding process performed on the input audio signals inevitably causes reduction of audio signal quality. A larger quantity of cascade encoding/decoding processes causes a greater reduction of the audio signal quality. Consequently, the clarity and quality of speech signals in the input audio signals transmitted between two terminals deteriorates greatly as multiple encoding and decoding processes are performed on the input audio signal. Two parties of a voice call will have a hard time clearly hear and comprehend the speech content of each other. That is, speech intelligibility is reduced by the cascade encoding/decoding processes required to support the signal transmission between the devices of the two parties.

SUMMARY

According to various embodiments of this application, and a speech signal cascade processing method, a terminal, and a non-volatile a computer-readable storage medium are provided.

In one aspect, a method for improving speech signal clarity is performed at a first terminal having one or more processors and memory. A speech signal is obtained, where the speech signal is from a second terminal via a voice communication channel. The speech signal is processed with different audio codecs at the first terminal and the second terminal, respectively. The second terminal encodes the speech signal transmissions made through the voice communication channel using a second audio codec and the first terminal decodes the speech signal transmission made through the voice communication channel using a first audio codec. Through feature recognition on the speech signal, first terminal determines a set of feature characteristics. Next the first terminal performs pre-augmented filtering on the speech signal by using a first set of pre-augmented filter coefficients to obtain a pre-augmented speech signal when the set of feature characteristics matches a first set of predefined features or performs pre-augmented filtering on the speech signal by using a second set of pre-augmented filter coefficients to obtain the pre-augmented speech signal when the set of feature characteristics matches a second set of predefined features. Finally, the first terminal performs cascade encoding/decoding to the pre-augmented speech signal to generate an augmented speech signal.

According to a second aspect of the present disclosure, a first terminal includes one or more processors, memory, and a plurality of computer programs stored in the memory that, when executed by the one or more processors, cause the first terminal to perform the aforementioned method.

According to a third aspect of the present disclosure, a non-transitory computer readable storage medium storing a plurality of computer programs configured for execution by a first terminal having one or more processors, the plurality of computer programs causing the first terminal to perform the aforementioned method.

Details of one or more embodiments of the present invention are provided in the following accompanying drawings and descriptions. Other features, objectives, and advantages of the present disclosure become clear in the specification, the accompanying drawings, and the claims.

BRIEF DESCRIPTION OF THE DRAWINGS

To describe the technical solutions in the embodiments of the present invention or in the existing technology more clearly, the following briefly describes the accompanying drawings required for describing the embodiments or the existing technology. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

To make the objectives, technical solutions, and advantages of the present disclosure clearer and more comprehensible, the following further describes the present disclosure in detail with reference to the accompanying drawings and embodiments. It should be understood that the specific embodiments described herein are merely used to explain the present disclosure but are not intended to limit the present disclosure.

It should be noted that the terms "first", "second", and the like that are used in the present disclosure can be used for describing various elements, but the elements are not limited by the terms. The terms are merely used for distinguishing one element from another element. For example, without departing from the scope of the present disclosure, a first client may be referred to as a second, and similar, a second client may be referred as a first client. Both of the first client and the second client are clients, but they are not a same client.

Figure 1:
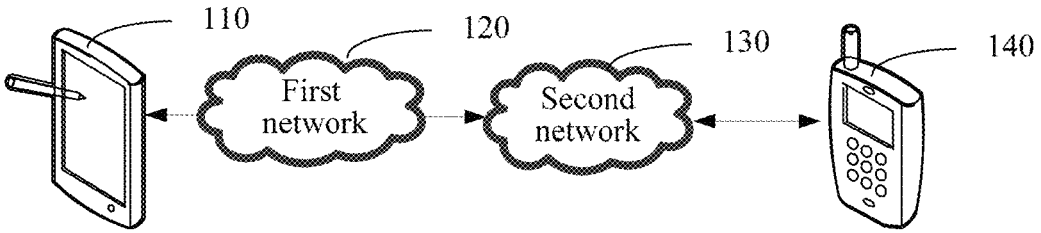
FIG. 1 is a schematic diagram of an application environment of a speech signal cascade processing method in an embodiment.

FIG. 1 is a schematic diagram of an application environment of a speech signal cascade processing method in an embodiment. As shown in FIG. 1, the first terminal performs a method for improving speech signal clarity, where the first terminal obtains a speech signal; the first terminal identifies a correspondence between the speech signal and a respective user group (e.g., different genders, different age groups, etc.) among different user groups having distinct voice characteristics; the first terminal performs pre-encoding signal augmentation on the speech signal to obtain a corresponding pre-augmented speech signal, including: if the speech signal corresponds to the first user group (e.g., male, or male of certain age group), the first terminal performs pre-encoding signal augmentation with a first pre-augmentation filtering coefficient; and if the speech signal corresponds to the second user group (e.g., female, or female of certain age group, or children, etc.), the first terminal performs pre-encoding signal augmentation with a second pre-augmentation filtering coefficient; and the first terminal encodes the pre-augmented speech signal for subsequent transmission through the voice communication channel, wherein an encoded version of the pre-augmented speech signal has reduced loss of signal quality as compared to an encoded version of the speech signal that is obtained without the pre-encoding signal augmentation. Specifically, as shown in FIG. 1, the application environment includes a first terminal 110, a first network 120, a second network 130, and a second terminal 140. The first terminal 110 receives a speech signal, and after encoding/decoding is performed on the speech signal in accordance with the transmission protocols of the first terminal 110, the first network 120, and the second network 130 (e.g., the encoding/decoding is performed at one or more devices along the transmission path from the first terminal to the second terminal according to the platforms, networks, applications, used by the one or more devices along the transmission path), the speech signal is received by the second terminal 140. The second terminal 140 performs the necessary decoding to output the recovered speech signal. In some embodiments, the first terminal 110 performs feature recognition on the speech signal; if the speech signal is a first feature signal (e.g., a feature signal that has characteristics corresponding to voice feature characteristics of a first user group), the first terminal 110 performs pre-augmented filtering on the first feature signal by using a first pre-augmented filter coefficient (e.g., a filtering coefficient trained based on speech samples for the first user group), to obtain a first pre-augmented speech signal; if the speech signal is a second feature signal (e.g., a feature signal that has characteristics corresponding to voice feature characteristics of a second user group), performs pre-augmented filtering on the second feature signal by using a second pre-augmented filter coefficient (e.g., a filtering coefficient trained based on speech samples for the second user group), to obtain second pre-augmented speech signal; and outputs the first pre-augmented speech signal or the second pre-augmented speech signal (e.g., to the next device along the transmission path). After cascade encoding/decoding is performed by the first network 120 and the second network 130, a pre-augmented cascade encoded/decoded signal is obtained, the second terminal 140 receives the pre-augmented cascade encoded/decoded signal (e.g., the speech signal that has gone through the pre-augmentation performed by the first terminal, and subsequent encoding/decoding processes performed by the first terminal and one or more intermediate devices on the first and second networks), and decodes the signal, the received and decoded signal has high intelligibility, e.g., the loss due to the cascade encoding/decoding processes are mitigated by the pre-augmentation performed on the speech signal, and the clarity of the signal is maintained at a high level. Similarly, the process can be performed in the reverse direction for a speech signal that is input by a user at the second terminal and needs to be transmitted to the first terminal. The first terminal 110 receives a speech signal that is sent by the second terminal 140 and that passes through the second network 130 and the first network 120, and likewise, pre-augmented filtering is performed on the received speech signal.

Figure 2:
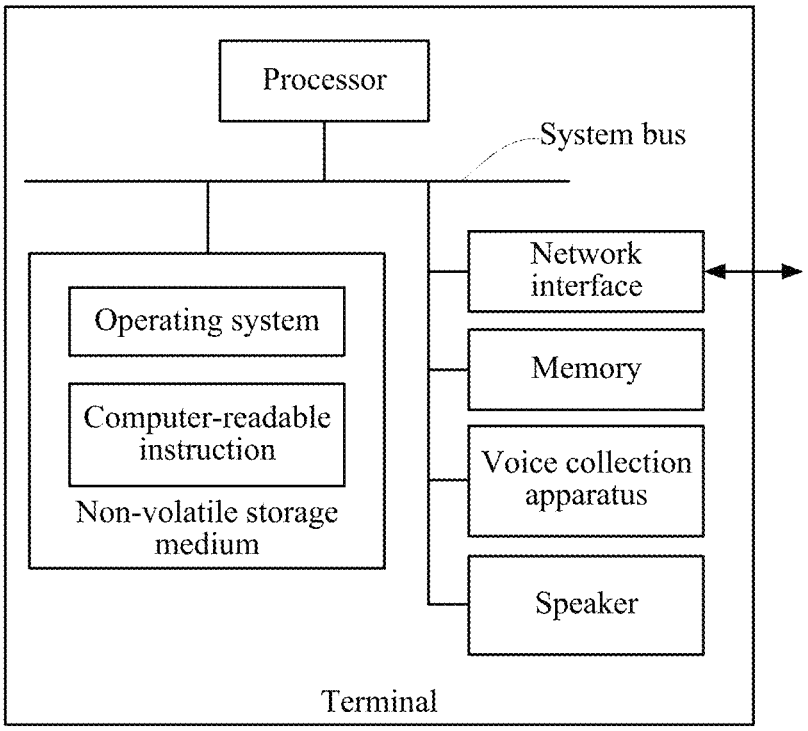
FIG. 2 is a schematic diagram of an internal structure of a terminal in an embodiment.

FIG. 2 is a schematic diagram of an internal structure of a terminal in an embodiment. As shown in FIG. 2, the terminal includes a processor, a storage medium, a memory, a network interface, a voice collection apparatus, and a speaker that are connected by using a system bus. The storage medium of the terminal stores an operating system and a computer-readable instruction. When the computer-readable instruction is executed, the processor is enabled to perform steps to implement a speech signal cascade processing method described herein. The processor is configured to provide calculation and control capabilities and support running of the entire terminal. The processor is configured to execute a speech signal cascade processing method described herein, including: obtaining a speech signal; identifying a correspondence between the speech signal and a respective user group among different user groups having distinct voice characteristics; performing pre-encoding signal augmentation on the speech signal to obtain a corresponding pre-augmented speech signal, including: if the speech signal corresponds to the first user group, performing pre-encoding signal augmentation with a first pre-augmentation filtering coefficient; and if the speech signal corresponds to the second user group, performing pre-encoding signal augmentation with a second pre-augmentation filtering coefficient; and encoding the pre-augmented speech signal for subsequent transmission through the voice communication channel, wherein an encoded version of the pre-augmented speech signal has reduced loss of signal quality as compared to an encoded version of the speech signal that is obtained without the pre-encoding signal augmentation. For example, the processor is configured to execute a speech signal cascade processing method, including: obtaining a speech signal; performing feature recognition on the speech signal; if the speech signal is a first feature signal, performing pre-augmented filtering on the first feature signal by using a first pre-augmented filter coefficient, to obtain a first pre-augmented speech signal; if the speech signal is a second feature signal, performing pre-augmented filtering on the second feature signal by using a second pre-augmented filter coefficient, to obtain a second pre-augmented speech signal; and outputting the first pre-augmented speech signal or the second pre-augmented speech signal, to perform cascade encoding/decoding according to the first pre-augmented speech signal or the second pre-augmented speech signal. The terminal may be a telephone, a mobile phone, a tablet computer, a personal digital assistant, or the like that can make a VoIP call. A person skilled in the art may understand that, in the structure shown in FIG. 2A, only a block diagram of a partial structure related to a solution in this application is shown, and does not constitute a limit to the terminal to which the solution in this application is applied. Specifically, the terminal may include more components or fewer components than those shown in the figure, or some components may be combined, or a different component deployment may be used.

Figure 3A:
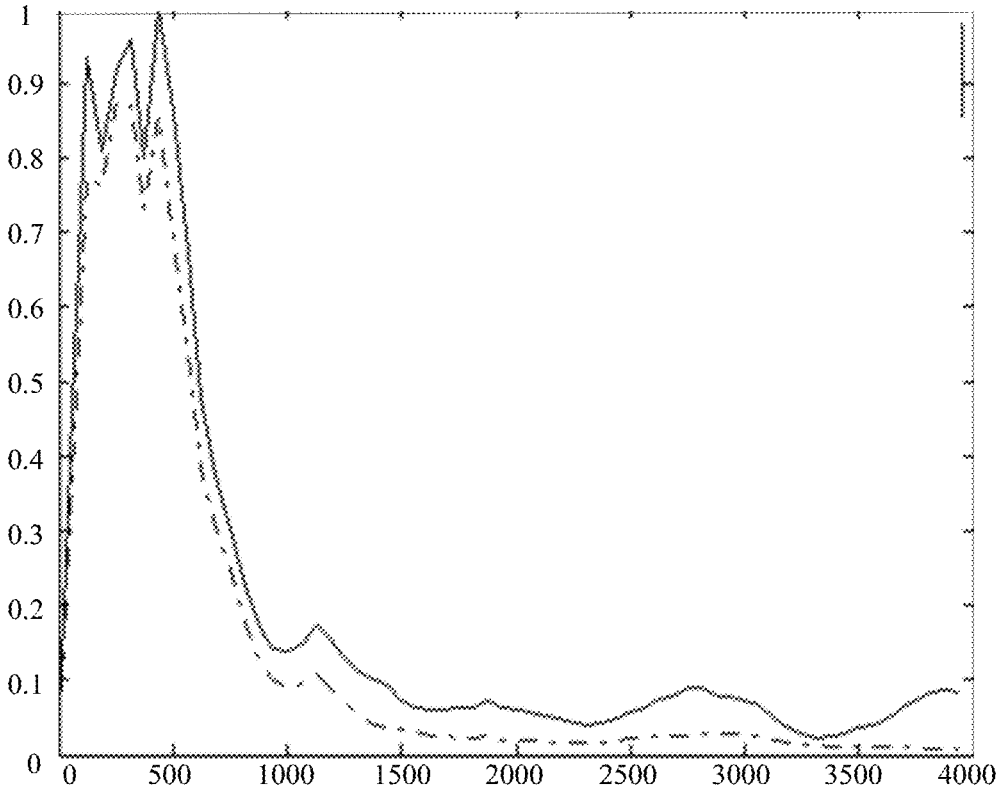
FIG. 3A is a schematic diagram of frequency energy loss of a first feature signal after cascade encoding/decoding in an embodiment.
Figure 3B:
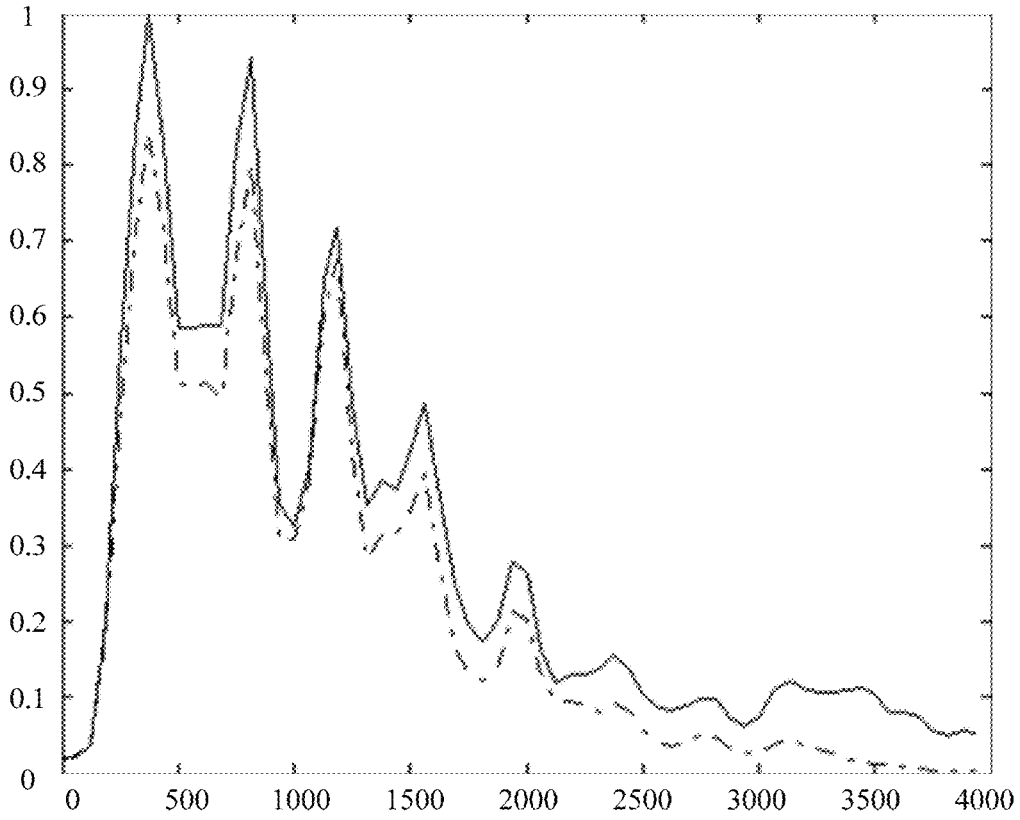
FIG. 3B is a schematic diagram of frequency energy loss of a second feature signal after cascade encoding/decoding in an embodiment.

For a cascade encoded/decoded speech signal, medium-high frequency energy thereof is particularly lossy, and speech intelligibility of a first feature signal (e.g., corresponding to male voice) and speech intelligibility of a second feature signal (e.g., corresponding to female voice) are affected to different degrees after cascade encoding/decoding because a key component that affects speech intelligibility is medium-high frequency energy information of a speech signal. Because a pitch frequency of the first feature signal (e.g., corresponding to male voice) is relatively low (usually, below 125 Hz), energy components of the first feature signal are mainly medium-low frequency components (below 1000 Hz), and there are relatively few medium-high frequency components (above 1000 Hz). A pitch frequency of the second feature signal (e.g., corresponding to female voice) is relatively high (usually, above 125 Hz), medium-high frequency components of the second feature signal are more than those of the first feature signal. As shown in FIG. 3A and FIG. 3B, after the cascade encoding/decoding, frequency energy of both of the first feature signal and the second feature signal is lossy and diminished. Because of a low proportion of medium-high frequency energy in the first feature signal, the medium-high frequency energy is lower after the cascade encoding/decoding. Hence, speech intelligibility of the first feature signal is greatly affected. Consequently, a listener feels that a heard sound is obscured and it is difficult to clearly discern the speech content of the audio corresponding to the first feature signal. However, although the medium-high frequency energy of the second feature signal is also lossy and diminished, after the cascade encoding, there is still enough medium-high frequency energy to provide sufficient speech intelligibility. In terms of a speech encoding/decoding principle, a speech synthesized by using Code Excited Linear Prediction (CELP) of an encoding/decoding model using a principle that a speech has a minimum hearing distortion is used as an example. Because spectrum energy distribution of a speech of the first feature signal is very disproportionate among different frequency bands, and most energy is distributed in medium-low frequency energy range, an encoding process will only mainly ensure a minimum medium-low frequency distortion, medium-high frequency energy occupying a relatively small energy proportion experiences a relatively large distortion. On the contrary, spectrum energy distribution of the second feature signal is relatively proportionate among different frequency bands, there are relatively many medium-high frequency energy components, and after the encoding/decoding, energy loss of the medium-high frequency energy components is relatively low, as compared to the first feature signal. That is, after the cascade encoding/decoding, the degree of reduction in intelligibility for first feature signal and the second feature signal are significantly different. A solid curve in FIG. 3A indicates an original audio signal of the first feature signal, and a dotted line indicates a degraded signal after cascade encoding/decoding. A solid curve in FIG. 3B indicates an original audio signal of the second feature signal, and a dotted line indicates a degraded signal after cascade encoding/decoding. Horizontal coordinates in FIG. 3A and FIG. 3B are frequencies, and vertical coordinates are energy and are normalized energy values. Normalization is performed based on a maximum peak value in the first feature signal or the second feature signal. The first feature signal may be a male voice signal, and the second feature signal may be a female voice signal.

Figure 4:
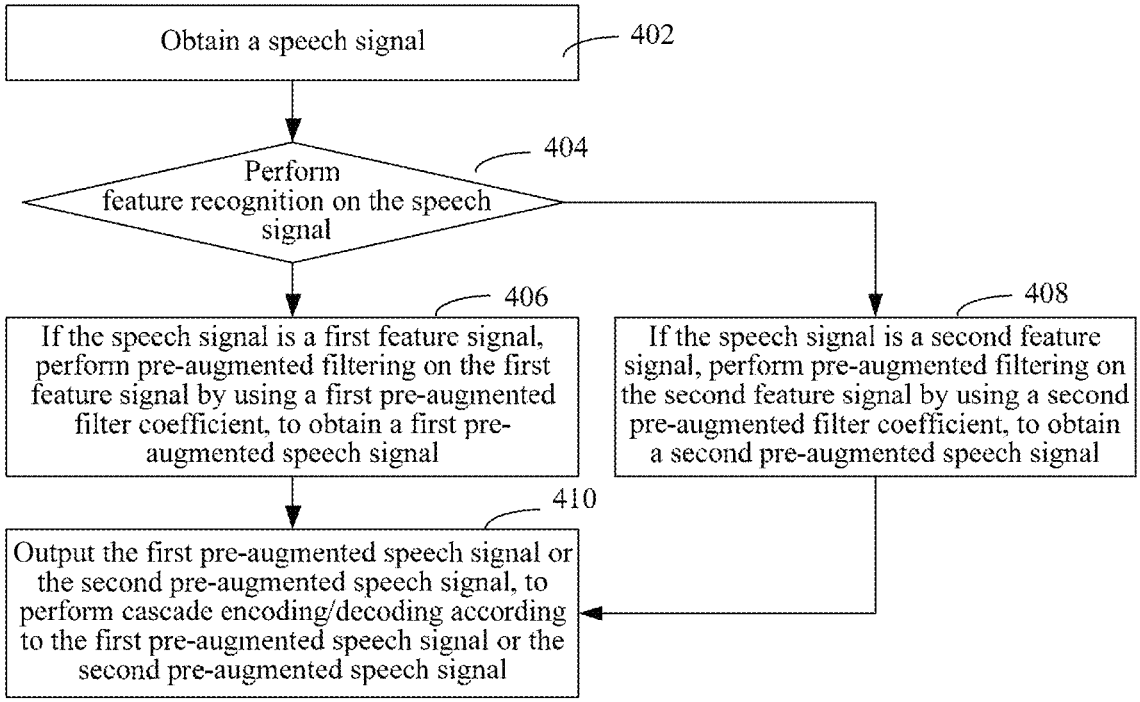
FIG. 4 is a flowchart of a speech signal cascade processing method in an embodiment.

FIG. 4 is a flowchart of a speech signal cascade processing method in an embodiment. As shown in FIG. 4, a speech signal cascade processing method, running on the terminal in FIG. 1, includes the following.

Step 402: Obtain a speech signal. For example, the terminal obtains a first speech signal, wherein the first speech signal includes a voice input captured at a first terminal of a voice communication channel established between the first terminal and a second terminal, and wherein the first terminal and the second terminal respective perform signal encoding and decoding on speech signal transmissions through the voice communication channel.

In this embodiment, the speech signal is a speech signal extracted from an original audio input signal captured by a microphone at the first terminal. The second terminal restores the original speech signal after cascade encoding/decoding, and recognizes the speech content from the restored original speech signal. The cascade encoding/decoding is related to an actual communication link at one or more junctions along the communication path through which the original speech signal passes. For example, to support inter-network communication between a G.729A IP phone and a GSM mobile phone, the cascade encoding/decoding may include G.729A encoding followed by G.729A decoding, followed by AMRNB encoding, and followed up AMRNB decoding.

Speech intelligibility is a degree to which a listener clearly hears and understands oral expression content of a speaker.

Step 404: Perform feature recognition on the speech signal. The first terminal identifies a correspondence between the first speech signal and a respective user group among different user groups having distinct voice characteristics, including performing feature recognition on the first speech signal to determine whether the first speech signal has a first predefined set of signal characteristics or a second predefined set of signal characteristics, wherein the first predefined set of signal characteristics and the second predefined set of signal characteristics respectively correspond to a first user group (e.g., male users) and a second user group (e.g., female users) having distinct voice characteristics;

In this embodiment, the performing feature recognition on the speech signal includes: obtaining a pitch period of the speech signal; and determining whether the pitch period of the speech signal is greater than a preset period value, where if the pitch period of the speech signal is greater than the preset period value, the speech signal is a first feature signal (e.g., corresponds to male voice); otherwise, the speech signal is a second feature signal (e.g., corresponds to female voice).

Specifically, a frequency of vocal cord vibration is referred to as a pitch frequency, and a corresponding period is referred to as a pitch period. A preset period value may be set according to needs. For example, the period is 60 sampling points. If the pitch period of the speech signal is greater than 60 sampling points, the speech signal is a first feature signal, and if the pitch period of the speech signal is less than or equal to 60 sampling points, the speech signal is a second feature signal.

The first terminal performs pre-encoding signal augmentation on the first speech signal to obtain a corresponding pre-augmented speech signal (e.g., steps 406 and 408), including: in accordance with a determination that the first speech signal corresponds to the first user group, performing pre-encoding signal augmentation on the first speech signal with a first pre-augmentation filtering coefficient to obtain a first pre-augmented speech signal as the corresponding pre-augmented speech signal for the first speech signal; and in accordance with a determination that the first speech signal corresponds to the second user group, performing pre-encoding signal augmentation on the first speech signal with a second pre-augmentation filtering coefficient distinct from the first pre-augmentation filtering coefficient to obtain a second pre-augmented speech signal as the corresponding pre-augmented speech signal for the first speech signal.

Step 406: If the speech signal is a first feature signal, perform pre-augmented filtering on the first feature signal by using a first pre-augmented filter coefficient, to obtain a first pre-augmented speech signal.

Step 408: If the speech signal is a second feature signal, perform pre-augmented filtering on the second feature signal by using a second pre-augmented filter coefficient, to obtain a second pre-augmented speech signal.

The first feature signal and the second feature signal may be speech signals in different band ranges (e.g., may be overlapping or non-overlapping).

Step 410: Output the first pre-augmented speech signal or the second pre-augmented speech signal, to perform cascade encoding/decoding according to the first pre-augmented speech signal or the second pre-augmented speech signal. The first terminal encodes the corresponding pre-augmented speech signal for subsequent transmission through the voice communication channel, wherein an encoded version of the corresponding pre-augmented speech signal has reduced loss of signal quality as compared to an encoded version of the first speech signal that is obtained without the pre-encoding signal augmentation.

The foregoing speech signal cascade processing method includes: by means of performing feature recognition on the speech signal, performing pre-augmented filtering on the first feature signal by using the first pre-augmented filter coefficient, performing pre-augmented filtering on the second feature signal by using the second pre-augmented filter coefficient, and performing cascade encoding/decoding on the pre-augmented speech, so that a receiving party can hear speech information more clearly, thereby increasing intelligibility of a cascade encoded/decoded speech signal. Pre-augmented filtering is performed on the first feature signal and the second feature signal by respectively using corresponding filter coefficients, so that pertinence is stronger, and filtering is more accurate.

In an embodiment, before the obtaining a speech signal, the speech signal cascade processing method further includes: obtaining an original audio signal that is input at the first terminal; detecting whether the original audio signal is a speech signal or a non-speech signal; if the original audio signal is a speech signal, obtaining a speech signal; and if the original audio signal is a non-speech signal, performing high-pass filtering on the non-speech signal. For example, an original input audio signal is first received at the first terminal. The first terminal determines whether the original input audio signal includes user speech. In accordance with a determination that the original input audio signal includes speech, the first terminal performs the step of obtaining the first speech signal; and in accordance with a determination that the original input audio signal does not include speech, the first terminal performs high-pass filtering on the original input audio signal before encoding the original input audio signal for subsequent transmission through the voice communication channel.

In this embodiment, a sample speech signal is determined to be a speech signal or a non-speech signal by means of Voice Activity Detection (VAD).

The high-pass filtering is performed on the non-speech signal, to reduce noise of the signal.

In an embodiment, before the obtaining a speech signal, the speech signal cascade processing method further includes: performing offline training according to a training sample in an audio training set to obtain a first pre-augmented filter coefficient and a second pre-augmented filter coefficient. The first terminal or a server determines the first pre-augmentation filter coefficient and the second pre-augmentation filter coefficient by performing offline training according to training samples in a speech signal data set, wherein the training samples include first sample speech signals corresponding to the first user group and second sample speech signals corresponding to the second user group. In some embodiments, determining the first pre-augmentation filter coefficient and the second pre-augmentation filter coefficient includes: performing simulated encoding/decoding on the training samples to respectively obtain first degraded speech signals corresponding to the first sample speech signals and second degraded speech signals corresponding to the second sample speech signals; obtaining a first set of energy attenuation values between the first degraded speech signals and the corresponding first sample speech signals, and a second set of energy attenuation values between the second degraded speech signals and the corresponding second sample speech signals, wherein the first set of energy attenuation values include respective energy attenuation values corresponding to different frequencies for each of the first sample speech signals corresponding to the first user group, and wherein; and the second set of energy attenuation values include respective energy attenuation values corresponding to different frequencies for each of the second sample speech signals corresponding to the second user group; and calculating the first pre-augmentation filter coefficient and the second pre-augmentation filter coefficient based on the first set of energy attenuation values and the second set of energy attenuation values, respectively. In some embodiments, calculating the first pre-augmentation filter coefficient based on the first set of energy attenuation values includes: for a respective frequency of the different frequencies, averaging energy attenuation values in the first set of energy attenuation values corresponding to the respective frequency to obtain an average energy compensation value at the respective frequency for the first user group; and performing filter fitting according to the average energy compensation values at the different frequencies for the first user group to obtain the first pre-augmentation filter coefficient. In some embodiments, calculating the second pre-augmentation filter coefficient based on the second set of energy attenuation values includes: for a respective frequency of the different frequencies, averaging energy attenuation values in the second set of energy attenuation values corresponding to the respective frequency to obtain an average energy compensation value at the respective frequency for the second user group; and performing filter fitting according to the average energy compensation values at the different frequencies for the second user group to obtain the second pre-augmentation filter coefficient.

In this embodiment, a training sample in a male audio training set may be recorded or a speech signal obtained from the network by screening.

Figure 5:
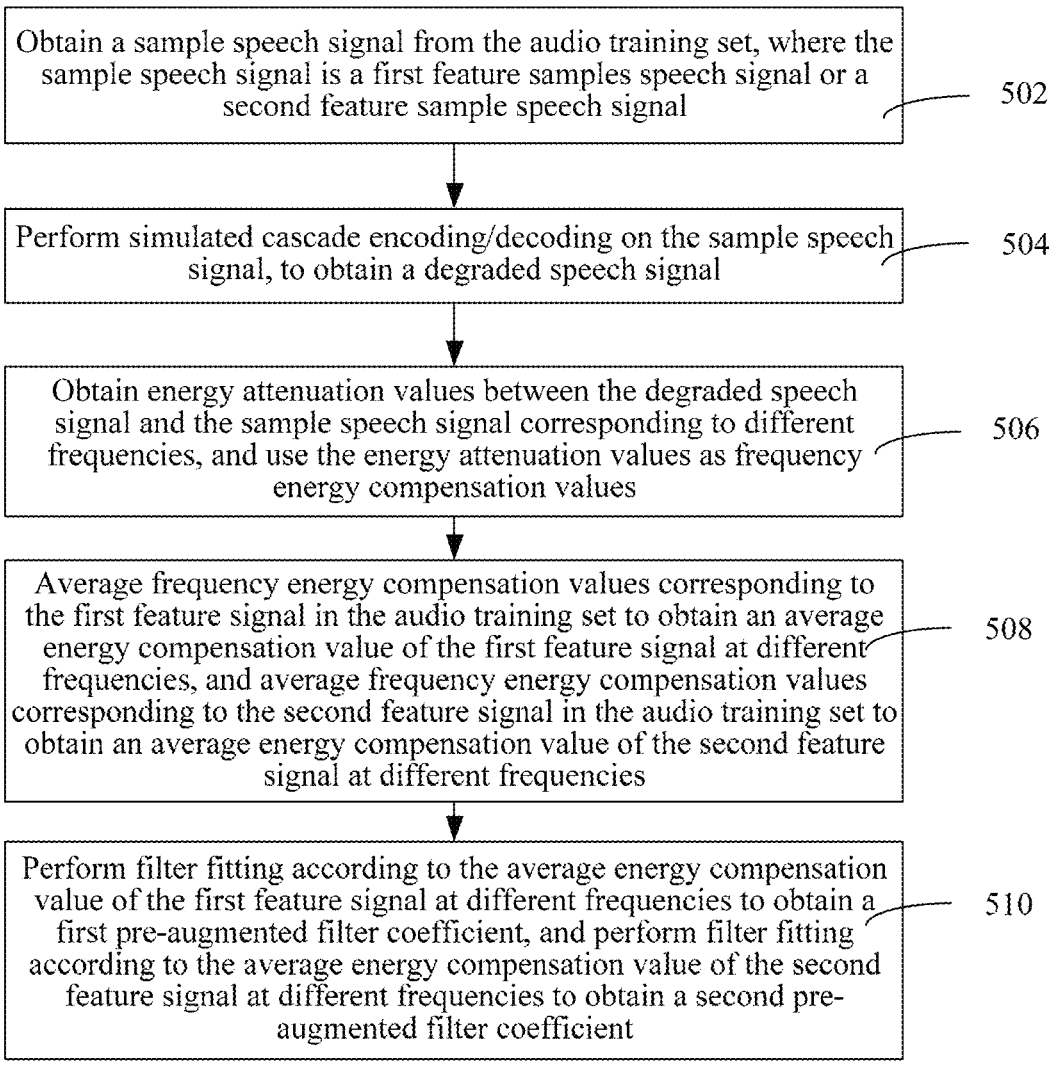
FIG. 5 is a detailed flowchart of performing offline training according to a training sample in an audio training set to obtain a first pre-augmented filter coefficient and a second pre-augmented filter coefficient.

As shown in FIG. 5, in an embodiment, the step of performing offline training according to a training sample in an audio training set to obtain a first pre-augmented filter coefficient and a second pre-augmented filter coefficient includes:

Step 502: Obtain a sample speech signal from the audio training set, where the sample speech signal is a first feature samples speech signal or a second feature sample speech signal.

In this embodiment, an audio training set is established in advance, and the audio training set includes a plurality of first feature sample speech signals and a plurality of second feature sample speech signals. The first feature sample speech signals and the second feature sample speech signals in the audio training set independently exist. The first feature sample speech signal and the second feature sample speech signal are sample speech signals of different feature signals.

After step 502, the method further includes: determining whether the sample speech signal is a speech signal, and if the sample speech signal is a speech signal, performing simulated cascade encoding/decoding on the sample speech signal, to obtain a degraded speech signal; otherwise, re-obtaining a sample speech signal from the audio training set. The first terminal receives an original input audio signal at the first terminal (e.g., capturing the audio by a microphone of the first terminal). The first terminal determines whether the original input audio signal includes user speech. In accordance with a determination that the original input audio signal includes speech, the first terminal performs the step of obtaining the first speech signal; and in accordance with a determination that the original input audio signal does not include speech, the first terminal performs high-pass filtering on the original input audio signal before encoding the original input audio signal for subsequent transmission through the voice communication channel.

In this embodiment, VAD is used to determine whether a sample speech signal is a speech signal (e.g., includes speech). The VAD is a speech detection algorithm, and estimates a speech based on energy, a zero-crossing rate, and low noise estimation.

The determining whether the sample speech signal is a speech signal includes steps (a1) to (a5):

Step (a1): Receive continuous speeches, and obtain speech frames from the continuous speeches.

Step (a2): Calculate energy of the speech frames, and obtain an energy threshold according to the energy.

Step (a3): Separately perform calculation to obtain zero-crossing rates of the speech frames, and obtain a zero-crossing rate threshold according to the zero-crossing rates.

Step (a4): Determine whether each speech frame is an active speech or an inactive speech by using a linear regression deduction method and using the energy obtained in step (a2) and the zero-crossing rates obtained in step (a3) as input parameters of the linear regression deduction method.

Step (a5): Obtain active speech starting points and active speech end points from the active speeches and the inactive speeches in step (a4) according to the energy threshold and the zero-crossing rate threshold.

The VAD detection method may be a double-threshold detection method or a speech detection method based on an autocorrelation maximum.

A process of the double-threshold detection method includes:

Step (b1): In a starting phase, perform pre-emphasis and framing, to divide a speech signal into frames.

Step (b2): Set initialization parameters, including a maximum mute length, a threshold of short-time energy, and a threshold of a short-time zero-crossing rate.

Step (b3): When it is determined that a speech is in a mute section or a transition section, if a short-time energy value of a speech signal is greater than a short-time energy high threshold, or a short-time zero-crossing rate of the speech signal is greater than a short-time zero-crossing rate high threshold, determine that a speech section is entered, and if the short-time energy value is greater than a short-time energy low threshold, or a zero-crossing rate value is greater than a zero-crossing rate low threshold, determine that the speech is in a transition section; otherwise, determine that the speech is still in the mute section.

Step (b4): When the speech signal is in the speech section, determine that the speech signal is still in the speech section if the short-time energy low threshold value is greater than the short-time energy low threshold or the short-time zero-crossing rate value is greater than short-time zero-crossing rate low threshold.

Step (b5): If the mute length is less than a specified maximum mute length, it indicates that the speech is not ended and is still in the speech section, and if a length of the speech is less than a minimum noise length, it is considered that the speech is too short, in this case, the speech is considered to be noise, and meanwhile, it is determined that the speech is in the mute section; otherwise, the speech enters an end section.

Step 504: Perform simulated cascade encoding/decoding on the sample speech signal, to obtain a degraded speech signal.

The simulated cascade encoding/decoding indicates simulating an actual link section through which the original speech signal passes. For example, if inter-network communication between a G.729A IP phone and a GSM mobile phone is supported, the cascade encoding/decoding may be G.729A encoding+G.729 decoding+AMRNB encoding+AMRNB decoding. After offline cascade encoding/decoding is performed on the sample speech signal, a degraded speech signal is obtained.

Step 506: Obtain energy attenuation values between the degraded speech signal and the sample speech signal corresponding to different frequencies, and use the energy attenuation values as frequency energy compensation values.

Specifically, an energy value corresponding to a degraded speech signal is subtracted from an energy value corresponding to a sample speech signal of each frequency to obtain an energy attenuation value of the corresponding frequency, and the energy attenuation value is a subsequently needed energy compensation value of the frequency.

Step 508: Average frequency energy compensation values corresponding to the first feature signal in the audio training set to obtain an average energy compensation value of the first feature signal at different frequencies, and average frequency energy compensation values corresponding to the second feature signal in the audio training set to obtain an average energy compensation value of the second feature signal at different frequencies.

Specifically, frequency energy compensation values corresponding to the first feature signal in the audio training set are averaged to obtain an average energy compensation value of the first feature signal at different frequencies, and frequency energy compensation values corresponding to the second feature signal in the audio training set are averaged to obtain an average energy compensation value of the second feature signal at different frequencies.

Step 510: Perform filter fitting according to the average energy compensation value of the first feature signal at different frequencies to obtain a first pre-augmented filter coefficient, and perform filter fitting according to the average energy compensation value of the second feature signal at different frequencies to obtain a second pre-augmented filter coefficient.

In this embodiment, based on the average energy compensation value of the first feature signal at different frequencies as a target, filter fitting is performed on the average energy compensation value of the first feature signal in an adaptive filter fitting manner to obtain a set of first pre-augmented filter coefficients. Based on the average energy compensation value of the second feature signal at different frequencies as a target, filter fitting is performed on the average energy compensation value of the second feature signal in an adaptive filter fitting manner to obtain a set of second pre-augmented filter coefficients.

The pre-augmented filter may be a Finite Impulse Response (FIR) filter:

$$y[n]=a_0*x[n]+a_1*x[n-1]+\ldots+a_m*x[n-m].$$

Pre-augmented filter coefficients $a_0$ to $a_m$, of the FIR filter may be obtained by performing calculation by using the fir2 function of Matlab. The function b=fir2(n,f,m) is used for designing a multi-pass-band arbitrary response function filter, and an amplitude-frequency property of the filter depends on a pair of vectors f and m, where f is a normalized frequency vector, m is an amplitude at a corresponding frequency, and n is an order of the filter. In this embodiment, an energy compensation value of each frequency is m, and is input into the fir2 function, so as to perform calculation to obtain b.

For the first pre-augmented filter coefficient and the second pre-augmented filter coefficient that are obtained by means of the foregoing offline training, the first pre-augmented filter coefficient and the second pre-augmented filter coefficient can be accurately obtained by means of offline training, to facilitate subsequently performing online filtering to obtain an augmented speech signal, thereby effectively increasing intelligibility of a cascade encoded/decoded speech signal.

Figure 6:
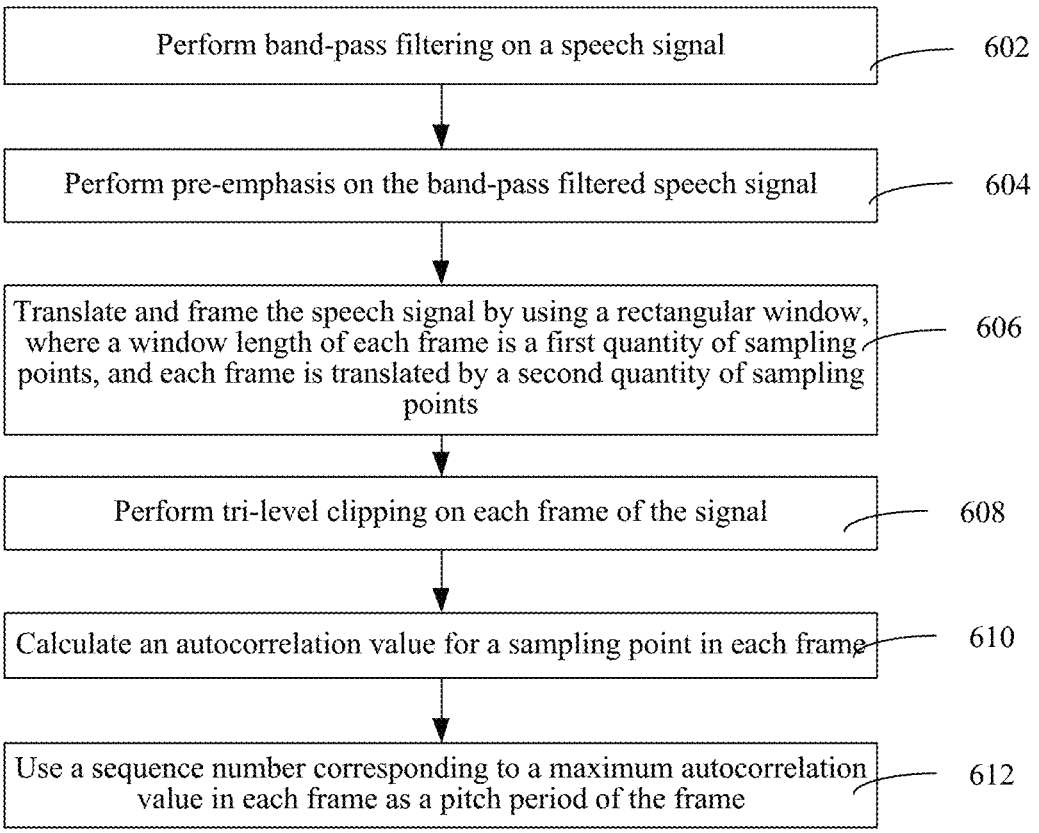
FIG. 6 shows a process of obtaining a pitch period of a speech signal in an embodiment.

As shown in FIG. 6, in an embodiment: the obtaining a pitch period of the speech signal includes the following steps.

Step 602: Perform band-pass filtering on the speech signal.

In this embodiment, an 80 to 1500 Hz filter may be used for performing band-pass filtering on the speech signal, or a 60 to 1000 Hz band-pass filter may be used for filtering. No limitation is imposed herein. That is, a frequency range of band-pass filtering is set according to specific requirements.

Step 604: Perform pre-enhancement on the band-pass filtered speech signal.

In this embodiment, pre-enhancement indicates that a sending terminal increases a high frequency component of an input signal captured at the sending terminal.

Step 606: Translate and frame the speech signal by using a rectangular window, where a window length of each frame is a first quantity of sampling points, and each frame is translated by a second quantity of sampling points.

In this embodiment, a length of a rectangular window is a first quantity of sampling points, the first quantity of sampling points may be 280, a second quantity of sampling points may be 80, and the first quantity of sampling points and the second quantity of sampling points are not limited thereto. 80 points correspond to data of 10 milliseconds (ms), and if translation is performed by 80 points, new data of 10 ms is introduced into each frame for calculation.

Step 608: Perform tri-level clipping on each frame of the signal.

In this embodiment, for tri-level clipping is performed. For example, positive and negative thresholds are set, if a sample value is greater than the positive threshold, 1 is output, if the sample value is less than the negative threshold, −1 is output, and in other cases, 0 is output.

Figure 7:
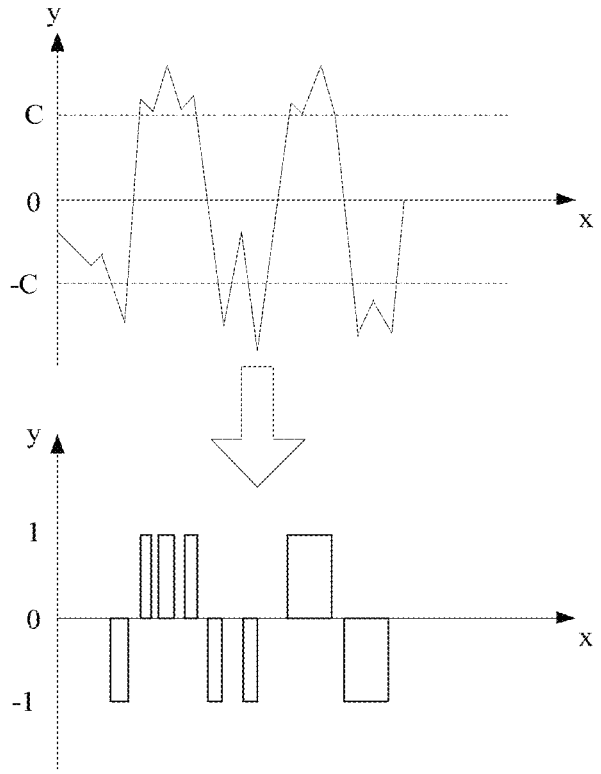
FIG. 7 is a schematic principle diagram of tri-level clipping.

As shown in FIG. 7, the positive threshold is C, and the negative threshold is −C. If the sample value exceeds the threshold C, 1 is output, if the sample value is less than the negative threshold −C, −1 is output, and in other cases, 0 is output.

Tri-level clipping is performed on each frame of the signal to obtain t(i), where a value range of i is 1 to 280.

Step 610: Calculate an autocorrelation value for a sampling point in each frame.

In this embodiment, calculating an autocorrelation value for a sampling point in each frame is dividing a product of two factors by a product of their respective square roots. A formula for calculating an autocorrelation value is:

$$r(k)=\sum_{l=1}^{121}(t(k+l-1)*t(l))\Big/\left(\mathrm{sqrt}\left(\sum_{l=1}^{121}(t(k+l-1)*t(k+l-1))\right)*\mathrm{sqrt}\left(\sum_{l=1}^{121}(t(l)*t(l))\right)\right),\ k=20\sim160,$$

where r(k) is an autocorrelation value, t(k+l−1) is a result of performing tri-level clipping on the corresponding (k+l−1), a value range of 20 to 160 of k is a common pitch period search range, if the range is converted to a pitch frequency range, the range is 8000/20 to 8000/160, that is, a range of 50 Hz to 400 Hz, which is a normal pitch frequency range of human voice, and if k exceeds the range of 20 to 160, it can be considered that the k does not fall within the normal pitch frequency range of human voice, no calculation is needed, and calculation time is saved.

Because a maximum value of k is 160, and a maximum value of l is 121, a broadest range oft is 160+121−1=280, so that a maximum value of i in the tri-level clipping is 280.

Step 612: Use a sequence number corresponding to a maximum autocorrelation value in each frame as a pitch period of the frame.

In this embodiment, a sequence number corresponding to a maximum autocorrelation value in each frame can be obtained by calculating an autocorrelation value in each frame, and the sequence number corresponding to the maximum autocorrelation value is used a pitch period of each frame.

In other embodiments, step 602 and step 604 can be omitted.

Figure 8:
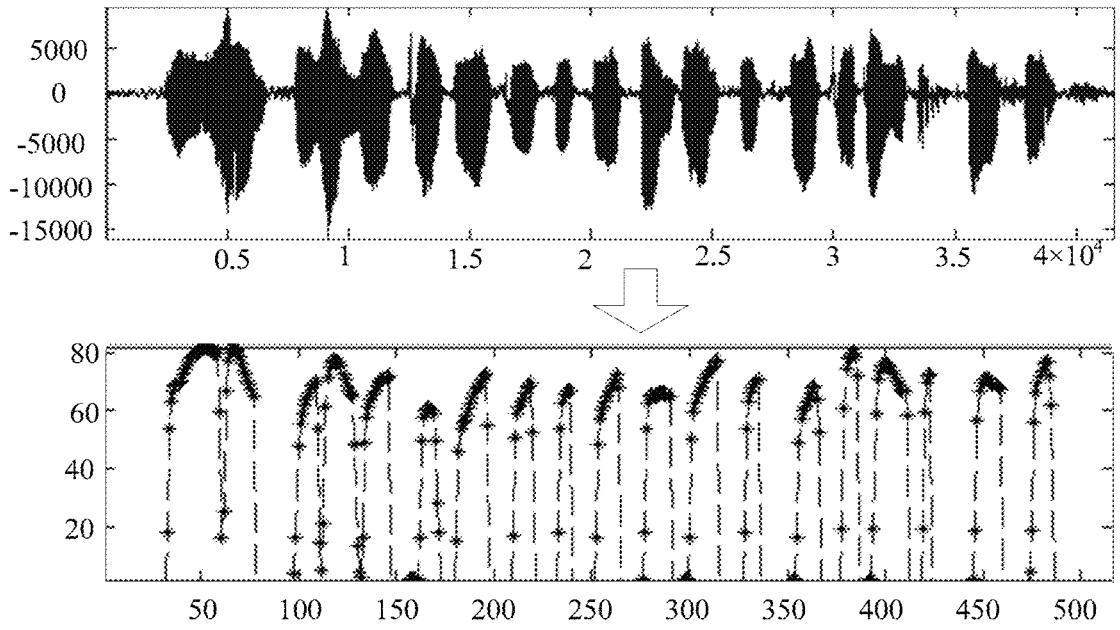
FIG. 8 is a schematic diagram of a pitch period calculation result of a speech segment.

FIG. 8 is a schematic diagram of a pitch period calculation result of a speech segment. As shown in FIG. 8, a horizontal coordinate in the first figure is a sequence number of a sampling point, and a vertical coordinate is a sample value of the sampling point, that is, an amplitude of the sampling point. It can be known that a sample value of a sampling point changes, some sampling points have large sample values, and some sampling points have small sample values. In the second figure, a horizontal coordinate is a quantity of frames, a vertical coordinate is a pitch period value. A pitch period is obtained for a speech frame, and for a non-speech frame, a pitch period is 0 by default.

Figure 9:
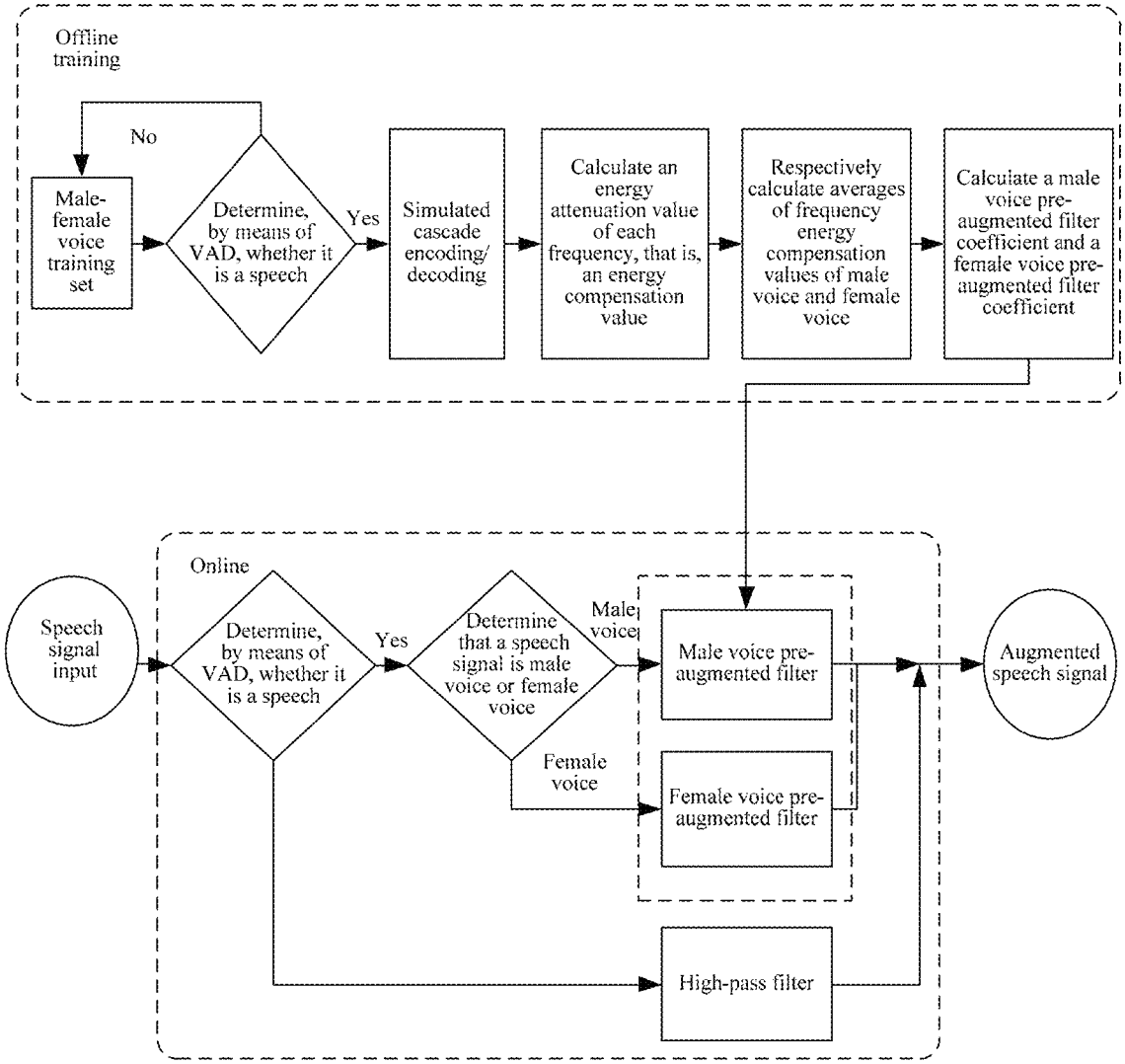
FIG. 9 is a schematic diagram of augmenting a speech input signal of an online call by using a pre-augmented filter coefficient obtained by offline training in an embodiment.

The foregoing speech signal cascade processing method is described below with reference to specific embodiments. As shown in FIG. 9, in an example in which the first feature signal is male voice, and the second feature signal is female voice, the foregoing speech signal cascade processing method includes an offline training portion and an online processing portion. The offline training portion includes:

Step (c1): Obtain sample speech signal from a male-female combined voice training set.

Step (c2): Determine whether the sample speech signal is a speech signal by means of VAD, if the sample speech signal is a speech signal, perform step (c3), and if the sample speech signal is a non-speech signal, return to step (c2).

Step (c3): If the sample speech signal is a speech signal, perform simulated cascade encoding/decoding on the sample speech signal, to obtain a degraded speech signal.

A plurality of encoding/decoding sections needs to be passed through when the sample speech signal passes through an actual link section. For example, if inter-network communication between a G.729A IP phone and a GSM mobile phone is supported, the cascade encoding/decoding may be G.729A encoding+G.729 decoding+AMRNB encoding+AMRNB decoding. After offline cascade encoding/decoding is performed on the sample speech signal, a degraded speech signal is obtained.

Step (c4): Calculate each frequency energy attenuation value, that is, an energy compensation value.

Specifically, an energy value corresponding to a degraded speech signal is subtracted from an energy value corresponding to a sample speech signal of each frequency to obtain an energy attenuation value of the corresponding frequency, and the energy attenuation value is a subsequently needed energy compensation value of the frequency.

Step (c5): Separately calculate average values of frequency energy compensation values of male voice and female voice.

Frequency energy compensation values corresponding to the male voice in the male-female voice training set are averaged to obtain an average energy compensation value of the male voice at different frequencies, and frequency energy compensation values corresponding to the female voice in the male-female voice training set are averaged to obtain an average energy compensation value of the female voice at different frequencies.

Step (c6): Calculate a male voice pre-augmented filter coefficient and a female voice pre-augmented filter coefficient.

Based on the average energy compensation value of the male voice at different frequencies as a target, filter fitting is performed on the average energy compensation value of the male voice in an adaptive filter fitting manner to obtain a set of male voice pre-augmented filter coefficients. Based on the average energy compensation value of the female voice at different frequencies as a target, filter fitting is performed on the average energy compensation value of the female voice in an adaptive filter fitting manner to obtain a set of female voice pre-augmented filter coefficients.

The online training portion includes:

Step (d1): Input a speech signal.

Step (d2): Determine whether the signal is a speech signal by means of VAD, if the signal is a speech signal, perform step (d3), and if the signal is a non-speech signal, perform step (d4).

Step (d3): Determine that the speech signal is male voice or female voice, if the speech signal is male voice, perform step (d4), and if the speech signal is female voice, perform step (d5).

Step (d4): Invoke a male voice pre-augmented filter coefficient obtained by means of offline training to perform pre-augmented filtering on a male voice speech signal, to obtain an augmented speech signal.

Step (d5): Invoke a female voice pre-augmented filter coefficient obtained by means of offline training to perform pre-augmented filtering on a female voice speech signal, to obtain an augmented speech signal.

Step (d6): Perform high-pass filtering on the non-speech signal, to obtain an augmented speech.

The foregoing speech intelligibility increasing method includes perform high-pass filtering on a non-speech, reducing noise of a signal, recognizing that a speech signal is a male voice signal or a female voice signal, performing pre-augmented filtering on the male voice signal by using a male voice pre-augmented filter coefficient obtained by means of offline training, and performing pre-augmented filtering on the female voice signal by using a female voice pre-augmented filter coefficient obtained by means of offline training. Performing augmented filtering on the male voice signal and the female voice signal by using corresponding filter coefficients respectively improves intelligibility of the speech signal. Because processing is respectively performed for male voice and female voice, pertinence is stronger, and filtering is more accurate.

Figure 10:
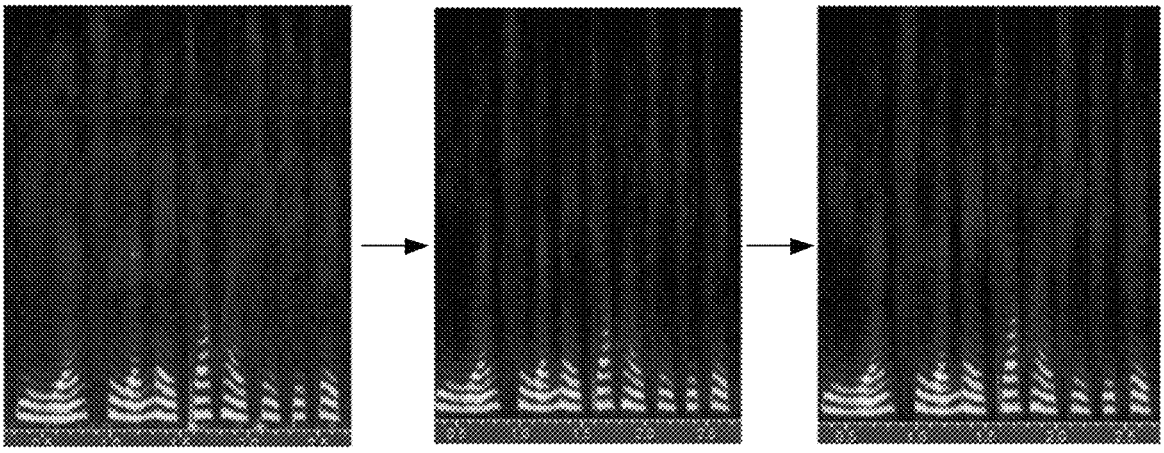
FIG. 10 is a schematic diagram of a cascade encoded/decoded signal obtained after pre-augmenting a cascade encoded/decoded signal.

FIG. 10 is a schematic diagram of a cascade encoded/decoded signal obtained after pre-augmenting a cascade encoded/decoded signal. As shown in FIG. 10, the first figure shows an original signal, the second figure shows a cascade encoded/decoded signal, and the third figure shows a cascade encoded/decoded signal obtained after pre-augmented filtering. In view of the above, the pre-augmented cascade encoded/decoded signal, compared with the cascade encoded/decoded signal, has stronger energy, and sounds clearer and more intelligible, so that intelligibility of a speech is increased.

Figure 11:
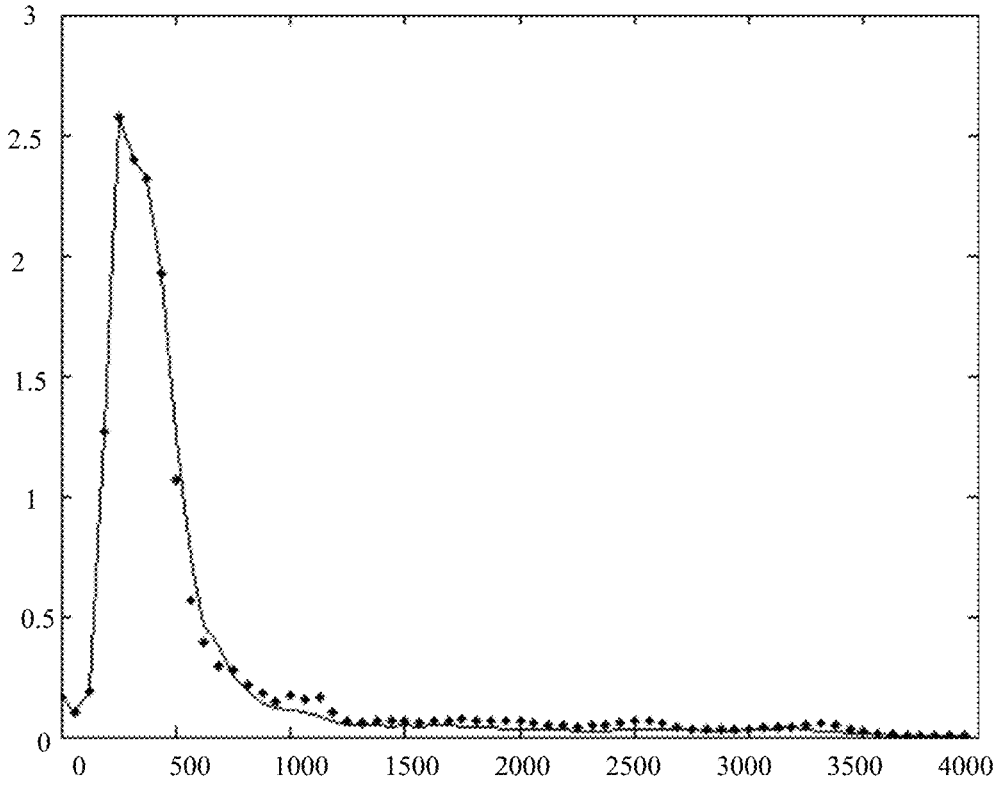
FIG. 11 is a schematic diagram of comparison between a signal spectrum of a cascade encoded/decoded signal that is not augmented and an augmented cascade encoded/decoded signal.

FIG. 11 is a schematic diagram of comparison between a signal spectrum of a cascade encoded/decoded signal that is not augmented and an augmented cascade encoded/decoded signal. As shown in FIG. 11, a curve is a spectrum of a cascade encoded/decoded signal that is not augmented, each point is a spectrum of an augmented cascade encoded/decoded signal, a horizontal coordinate is a frequency, a vertical coordinate is absolute energy, strength of the spectrum of the augmented signal is increased, and intelligibility is increased.

Figure 12:
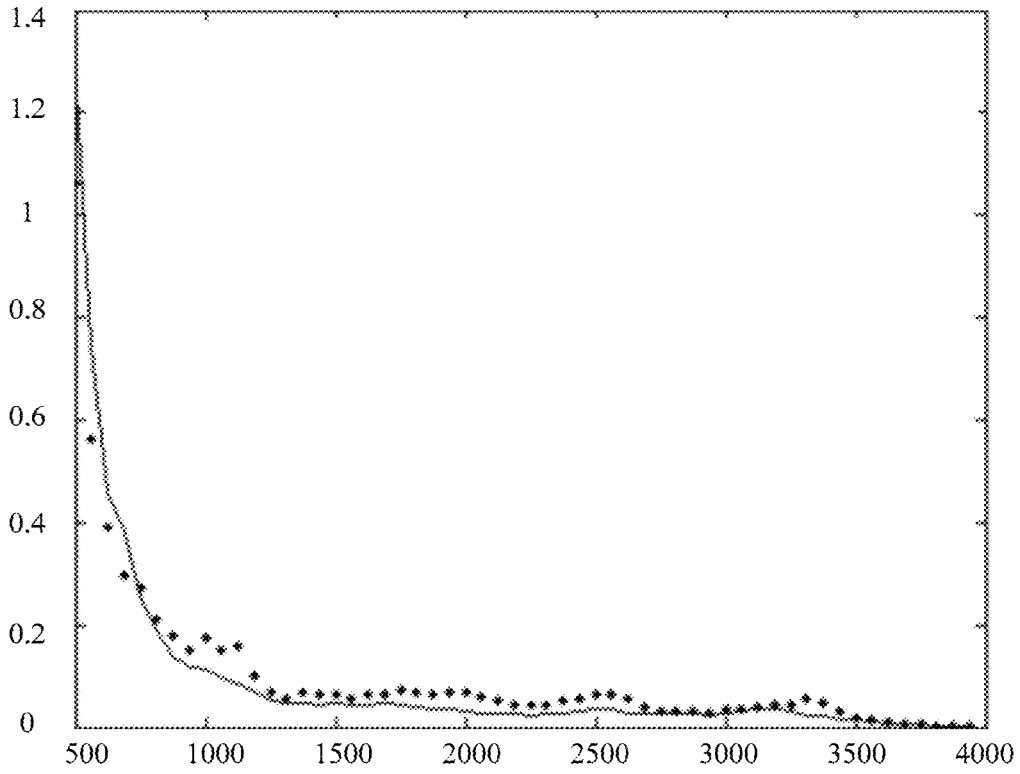
FIG. 12 is a schematic diagram of comparison between a medium-high frequency portion of a signal spectrum of a cascade encoded/decoded signal that is not augmented and a medium-high frequency portion of an augmented cascade encoded/decoded signal.

FIG. 12 is a schematic diagram of comparison between a medium-high frequency portion of a signal spectrum of a cascade encoded/decoded signal that is not augmented and a medium-high frequency portion of an augmented cascade encoded/decoded signal. A curve is a spectrum of a cascade encoded/decoded signal that is not augmented, each point is a spectrum of an augmented cascade encoded/decoded signal, a horizontal coordinate is a frequency, a vertical coordinate is absolute energy, strength of the spectrum of the augmented signal is increased, after the medium-high frequency portion is pre-augmented, the signal has stronger energy, and intelligibility is increased.

Figure 13:
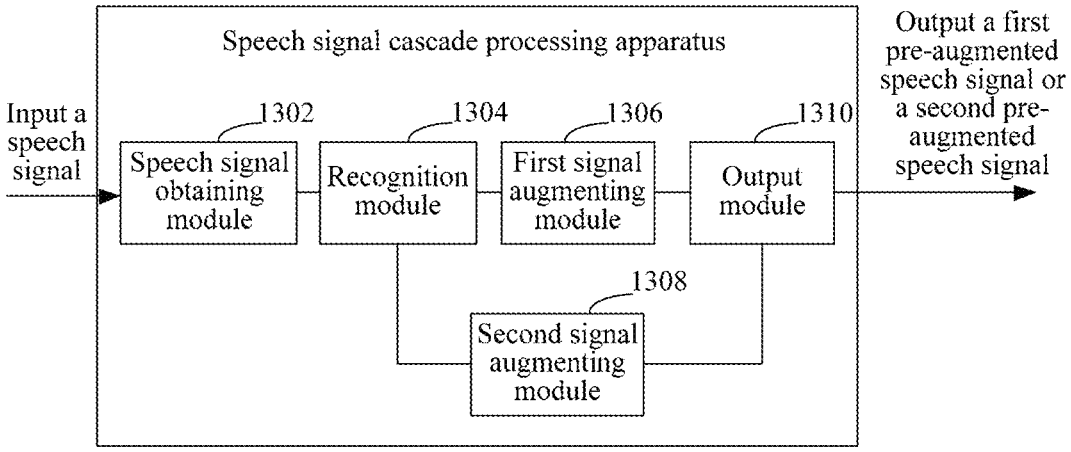
FIG. 13 is a structural block diagram of a speech signal cascade processing apparatus in an embodiment.

FIG. 13 is a structural block diagram of a speech signal cascade processing apparatus in an embodiment. As shown in FIG. 13, a speech signal cascade processing apparatus includes a speech signal obtaining module 1302, a recognition module 1304, a first signal augmenting module 1306, a second signal augmenting module 1308, and an output module 1310.

The speech signal obtaining module 1302 is configured to obtain a speech signal.

The recognition module 1304 is configured to perform feature recognition on the speech signal.

The first signal augmenting module 1306 is configured to if the speech signal is a first feature signal, perform pre-augmented filtering on the first feature signal by using a first pre-augmented filter coefficient, to obtain a first pre-augmented speech signal.

The second signal augmenting module 1308 is configured to if the speech signal is a second feature signal, perform pre-augmented filtering on the second feature signal by using a second pre-augmented filter coefficient, to obtain a second pre-augmented speech signal.

The output module 1310 is configured to output the first pre-augmented speech signal or the second pre-augmented speech signal, to perform cascade encoding/decoding according to the first pre-augmented speech signal or the second pre-augmented speech signal.

The foregoing speech signal cascade processing apparatus, by means of performing feature recognition on the speech signal, performs pre-augmented filtering on the first feature signal by using the first pre-augmented filter coefficient, performs pre-augmented filtering on the second feature signal by using the second pre-augmented filter coefficient, and performs cascade encoding/decoding on the pre-augmented speech, so that a receiving party can hear speech information more clearly, thereby increasing intelligibility of a cascade encoded/decoded speech signal. Pre-augmented filtering is performed on the first feature signal and the second feature signal by respectively using corresponding filter coefficients, so that pertinence is stronger, and filtering is more accurate.

Figure 14:
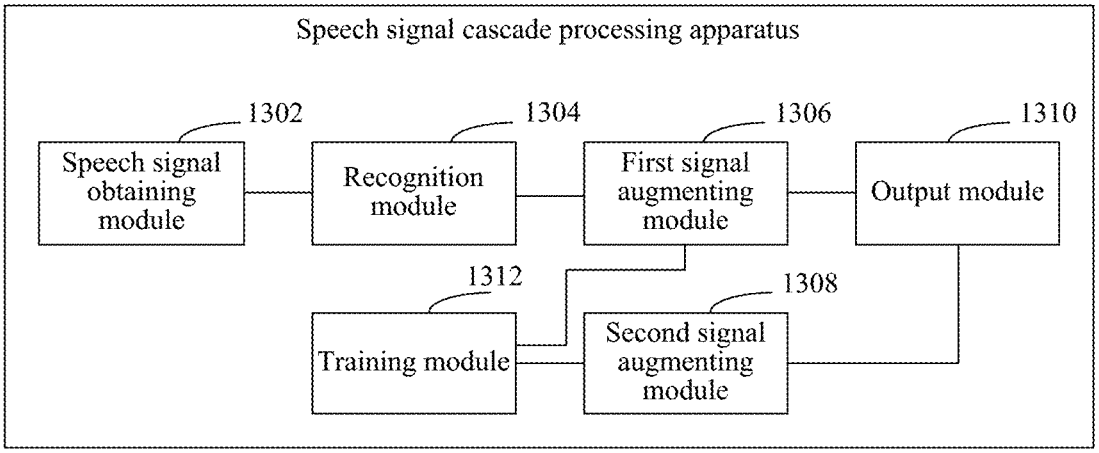
FIG. 14 is a structural block diagram of a speech signal cascade processing apparatus in another embodiment.

FIG. 14 is a structural block diagram of a speech signal cascade processing apparatus in another embodiment. As shown in FIG. 14, a speech signal cascade processing apparatus includes a speech signal obtaining module 1302, a recognition module 1304, a first signal augmenting module 1306, a second signal augmenting module 1308, an output module 1310, and a training module 1312.

The training module 1312 is configured to before the speech signal is obtained, perform offline training according to a training sample in an audio training set to obtain a first pre-augmented filter coefficient and a second pre-augmented filter coefficient.

Figure 15:
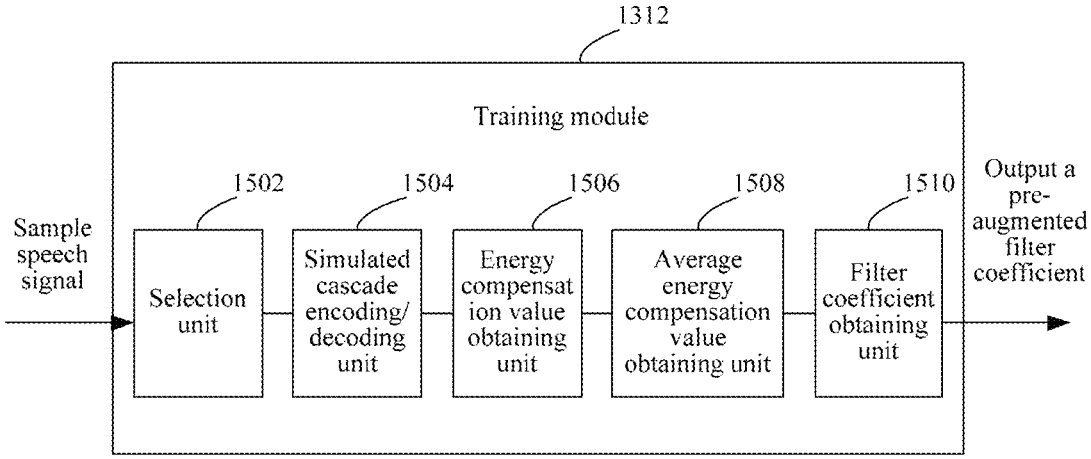
FIG. 15 is a schematic diagram of an internal structure of a training module in an embodiment.

FIG. 15 is a schematic diagram of an internal structure of a training module in an embodiment. As shown in FIG. 15, the training module 1310 includes a selection unit 1502, a simulated cascade encoding/decoding unit 1504, an energy compensation value obtaining unit 1506, an average energy compensation value obtaining unit 1508, and a filter coefficient obtaining unit 1510.

The selection unit 1502 is configured to obtain a sample speech signal from an audio training set, where the sample speech signal is a first feature samples speech signal or a second feature sample speech signal.

The simulated cascade encoding/decoding unit 1504 is configured to perform simulated cascade encoding/decoding on the sample speech signal, to obtain a degraded speech signal.

The energy compensation value obtaining unit 1506 is configured to obtain energy attenuation values between the degraded speech signal and the sample speech signal corresponding to different frequencies, and use the energy attenuation values as frequency energy compensation values.

The average energy compensation value obtaining unit 1508 is configured to average frequency energy compensation values corresponding to the first feature signal in the audio training set to obtain an average energy compensation value of the first feature signal at different frequencies, and average frequency energy compensation values corresponding to the second feature signal in the audio training set to obtain an average energy compensation value of the second feature signal at different frequencies.

The filter coefficient obtaining unit 1510 is configured to perform filter fitting according to the average energy compensation value of the first feature signal at different frequencies to obtain a first pre-augmented filter coefficient, and perform filter fitting according to the average energy compensation value of the second feature signal at different frequencies to obtain a second pre-augmented filter coefficient.

For the first pre-augmented filter coefficient and the second pre-augmented filter coefficient that are obtained by means of the foregoing offline training, the first pre-augmented filter coefficient and the second pre-augmented filter coefficient can be accurately obtained by means of offline training, to facilitate subsequently performing online filtering to obtain an augmented speech signal, thereby effectively increasing intelligibility of a cascade encoded/decoded speech signal.

In an embodiment, the recognition module 1304 is further configured to obtain a pitch period of the speech signal; and determine whether the pitch period of the speech signal is greater than a preset period value, where if the pitch period of the speech signal is greater than the preset period value, the speech signal is a first feature signal; otherwise, the speech signal is a second feature signal.

Further, the recognition module 1304 is further configured to translate and frame the speech signal by using a rectangular window, where a window length of each frame is a first quantity of sampling points, and each frame is translated by a second quantity of sampling points; perform tri-level clipping on each frame of the signal; calculate an autocorrelation value for a sampling point in each frame; and use a sequence number corresponding to a maximum autocorrelation value in each frame as a pitch period of the frame.

Further, the recognition module 1304 is further configured to before the translating and framing the speech signal by using a rectangular window, where a window length of each frame is a first quantity of sampling points, and each frame is translated by a second quantity of sampling points, perform band-pass filtering on the speech signal; and perform pre-emphasis on the band-pass filtered speech signal.

Figure 16:
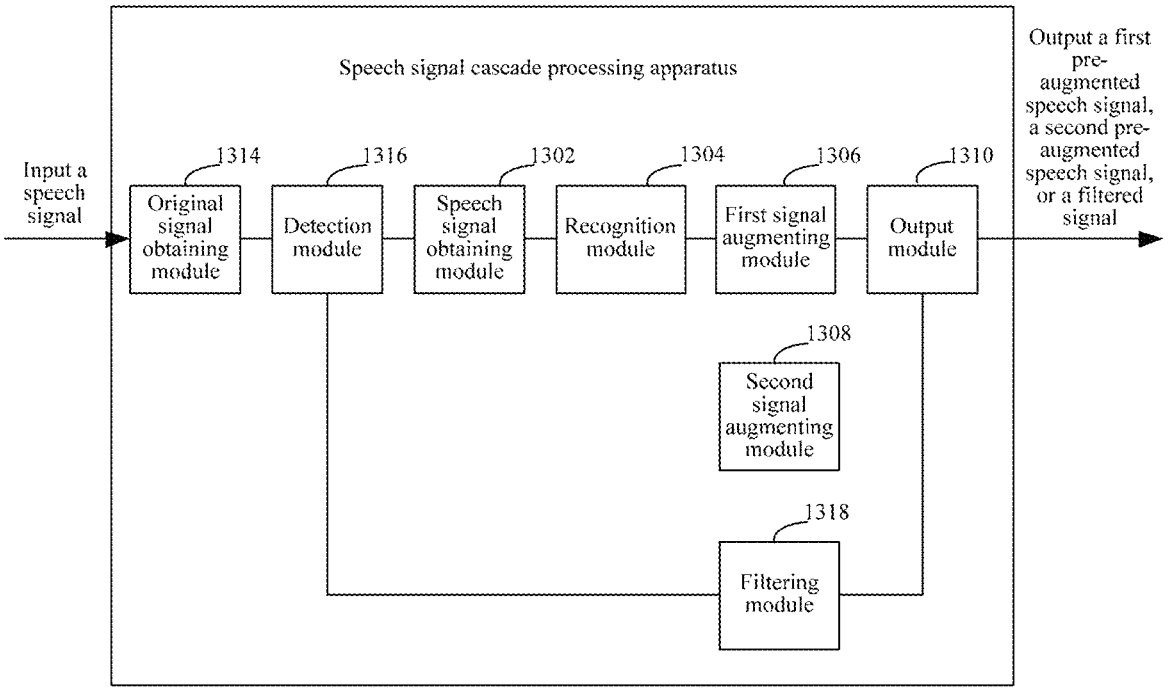
FIG. 16 is a structural block diagram of a speech signal cascade processing apparatus in another embodiment.

FIG. 16 is a structural block diagram of a speech signal cascade processing apparatus in another embodiment. As shown in FIG. 16, a speech signal cascade processing apparatus includes a speech signal obtaining module 1302, a recognition module 1304, a first signal augmenting module 1306, a second signal augmenting module 1308, and an output module 1310, and further includes an original signal obtaining module 1314, a detection module 1316, and a filtering module 1318.

The original signal obtaining module 1314 is configured to obtain an original audio signal that is input.

The detection module 1316 is configured to detect that the original audio signal is a speech signal or a non-speech signal.

The speech signal obtaining module 1302 is further configured to if the original audio signal is a speech signal, obtain a speech signal.

The filtering module 1318 is configured to if the original audio signal is a non-speech signal, perform high-pass filtering on the non-speech signal.

The foregoing speech signal cascade processing apparatus performs high-pass filtering on the non-speech signal, to reduce noise of the signal, by means of performing feature recognition on the speech signal, performs pre-augmented filtering on the first feature signal by using the first pre-augmented filter coefficient, performs pre-augmented filtering on the second feature signal by using the second pre-augmented filter coefficient, and performs cascade encoding/decoding on the pre-augmented speech, so that a receiving party can hear speech information more clearly, thereby increasing intelligibility of a cascade encoded/decoded speech signal. Pre-augmented filtering is performed on the first feature signal and the second feature signal by respectively using corresponding filter coefficients, so that pertinence is stronger, and filtering is more accurate.

In other embodiments, a speech signal cascade processing apparatus may include any combination of a speech signal obtaining module 1302, a recognition module 1304, a first signal augmenting module 1306, a second signal augmenting module 1308, an output module 1310, a training module 1312, an original signal obtaining module 1314, a detection module 1316, and a filtering module 1318.

A person of ordinary skill in the art may understand that all or some of the processes of the methods in the foregoing embodiments may be implemented by a computer program instructing relevant hardware. The program may be stored in a non-volatile computer-readable storage medium. When the program runs, the processes of the foregoing methods in the embodiments are performed. The storage medium may be a magnetic disc, an optical disc, a read-only memory (ROM), or the like.

The foregoing embodiments only show several implementations of the present disclosure and are described in detail, but they should not be construed as a limit to the patent scope of the present disclosure. It should be noted that, a person of ordinary skill in the art may make various changes and improvements without departing from the ideas of the present disclosure, which shall fall within the protection scope of the present disclosure. Therefore, the protection scope of the patent of the present disclosure shall be subject to the claims.

What is claimed is:

1. A speech signal cascade processing method performed at a first terminal having one or more processors and memory storing a plurality of computer programs to be executed by the one or more processors, comprising:

capturing a speech signal using a microphone of the first terminal;

performing feature recognition on the speech signal to determine a set of feature characteristics for the speech signal;

when the set of feature characteristics matches a first set of predefined features, performing pre-augmented filtering on the speech signal by using a first set of pre-augmented filter coefficients associated with a first user group, to obtain a pre-augmented speech signal;

when the set of feature characteristics matches a second set of predefined features, performing pre-augmented filtering on the speech signal by using a second set of pre-augmented filter coefficients that is different from the first set of pre-augmented filter coefficients and associated with a second user group that is different from the first user group, to obtain the pre-augmented speech signal, wherein the first set of pre-augmented filter coefficients boosts energy proportions of medium-high frequency of the speech signal more than the second set of pre-augmented filter coefficients does to the speech signal;

performing cascade encoding/decoding to the pre-augmented speech signal to generate an augmented speech signal;

processing the augmented speech signal using a first audio codec of the first terminal; and transmitting the processed augmented speech signal to a second terminal via a voice communication channel, wherein the second terminal processes the processed augmented speech signal using a second audio codec that is different from the first audio codec and then plays the augmented speech signal to a user of the second terminal.

2. The method according to claim 1, wherein before the obtaining a speech signal, the method further comprises:

performing offline training according to a training sample in an audio training set to obtain the first set of pre-augmented filter coefficients and the second set of pre-augmented filter coefficients, comprising:

obtaining a sample speech signal from the audio training set, wherein the sample speech signal is a first feature sample speech signal or a second feature sample speech signal;

performing simulated cascade encoding/decoding on the sample speech signal, to obtain a degraded speech signal;

obtaining energy attenuation values between the degraded speech signal and the sample speech signal corresponding to different frequencies, and using the energy attenuation values as frequency energy compensation values;

averaging frequency energy compensation values corresponding to the first feature signal in the audio training set to obtain an average energy compensation value of the first feature signal at different frequencies, and averaging frequency energy compensation values corresponding to the second feature signal in the audio training set to obtain an average energy compensation value of the second feature signal at different frequencies; and performing filter fitting according to the average energy compensation value of the first feature signal at different frequencies to obtain a first pre-augmented filter coefficient, and performing filter fitting according to the average energy compensation value of the second feature signal at different frequencies to obtain a second pre-augmented filter coefficient.

3. The method according to claim 1, wherein the performing feature recognition on the speech signal comprises:

obtaining a pitch period of the speech signal; and determining whether the pitch period of the speech signal is greater than a preset period value, wherein if the pitch period of the speech signal is greater than the preset period value, the speech signal is a first feature signal; otherwise, the speech signal is a second feature signal.

4. The method according to claim 3, wherein the obtaining a pitch period of the speech signal comprises:

translating and framing the speech signal by using a rectangular window, wherein a window length of each frame is a first quantity of sampling points, and each frame is translated by a second quantity of sampling points;

performing tri-level clipping on each frame of the signal;

calculating an autocorrelation value for a sampling point in each frame; and using a sequence number corresponding to a maximum autocorrelation value in each frame as a pitch period of the frame.

5. The method according to claim 4, wherein before the translating and framing the speech signal by using a rectangular window, wherein a window length of each frame is a first quantity of sampling points, and each frame is translated by a second quantity of sampling points, the obtaining a pitch period of the speech signal further comprises:

performing band-pass filtering on the speech signal; and performing pre-emphasis on the band-pass filtered speech signal.

6. The method according to claim 1, wherein before the obtaining a speech signal, the method further comprises:

obtaining an original audio signal;

dividing the original audio signal into the speech signal and a non-speech signal; and performing high-pass filtering on the non-speech signal.

7. A first terminal, comprising memory and one or more processors, the memory storing a plurality of computer programs that, when executed by the one or more processors, cause the terminal to perform a plurality of operations including:

capturing a speech signal using a microphone of the first terminal;

performing feature recognition on the speech signal to determine a set of feature characteristics for the speech signal;

when the set of feature characteristics matches a first set of predefined features, performing pre-augmented filtering on the speech signal by using a first set of pre-augmented filter coefficients associated with a first user group, to obtain a pre-augmented speech signal;

when the set of feature characteristics matches a second set of predefined features, performing pre-augmented filtering on the speech signal by using a second set of pre-augmented filter coefficients that is different from the first set of pre-augmented filter coefficients and associated with a second user group that is different from the first user group, to obtain the pre-augmented speech signal, wherein the first set of pre-augmented filter coefficients boosts energy proportions of medium-high frequency of the speech signal more than the second set of pre-augmented filter coefficients does to the speech signal;

performing cascade encoding/decoding to the pre-augmented speech signal to generate an augmented speech signal;

processing the augmented speech signal using a first audio codec of the first terminal; and transmitting the processed augmented speech signal to a second terminal via a voice communication channel, wherein the second terminal processes the processed augmented speech signal using a second audio codec that is different from the first audio codec and then plays the augmented speech signal to a user of the second terminal.

8. The first terminal according to claim 7, wherein the plurality of operations further comprise:

performing offline training according to a training sample in an audio training set to obtain the first set of pre-augmented filter coefficients and the second set of pre-augmented filter coefficients, comprising:

obtaining a sample speech signal from the audio training set, wherein the sample speech signal is a first feature sample speech signal or a second feature sample speech signal;

performing simulated cascade encoding/decoding on the sample speech signal, to obtain a degraded speech signal;

obtaining energy attenuation values between the degraded speech signal and the sample speech signal corresponding to different frequencies, and using the energy attenuation values as frequency energy compensation values;

averaging frequency energy compensation values corresponding to the first feature signal in the audio training set to obtain an average energy compensation value of the first feature signal at different frequencies, and averaging frequency energy compensation values corresponding to the second feature signal in the audio training set to obtain an average energy compensation value of the second feature signal at different frequencies; and performing filter fitting according to the average energy compensation value of the first feature signal at different frequencies to obtain a first pre-augmented filter coefficient, and performing filter fitting according to the average energy compensation value of the second feature signal at different frequencies to obtain a second pre-augmented filter coefficient.

9. The first terminal according to claim 7, wherein the performing feature recognition on the speech signal comprises:

obtaining a pitch period of the speech signal; and determining whether the pitch period of the speech signal is greater than a preset period value, wherein if the pitch period of the speech signal is greater than the preset period value, the speech signal is a first feature signal; otherwise, the speech signal is a second feature signal.

10. The first terminal according to claim 9, wherein the obtaining a pitch period of the speech signal comprises:

translating and framing the speech signal by using a rectangular window, wherein a window length of each frame is a first quantity of sampling points, and each frame is translated by a second quantity of sampling points;

performing tri-level clipping on each frame of the signal;

calculating an autocorrelation value for a sampling point in each frame; and using a sequence number corresponding to a maximum autocorrelation value in each frame as a pitch period of the frame.

11. The first terminal according to claim 10, wherein before the translating and framing the speech signal by using a rectangular window, wherein a window length of each frame is a first quantity of sampling points, and each frame is translated by a second quantity of sampling points, the obtaining a pitch period of the speech signal further comprises:

performing band-pass filtering on the speech signal; and performing pre-emphasis on the band-pass filtered speech signal.

12. The first terminal according to claim 7, wherein the plurality of operations further comprise:

obtaining an original audio signal;

dividing the original audio signal into the speech signal and a non-speech signal; and performing high-pass filtering on the non-speech signal.

13. A non-transitory computer readable storage medium storing a plurality of computer programs that, when executed by one or more processors of a first terminal, cause the first terminal to perform a plurality of operations including:

capturing a speech signal using a microphone of the first terminal;

performing feature recognition on the speech signal to determine a set of feature characteristics for the speech signal;

when the set of feature characteristics matches a first set of predefined features, performing pre-augmented filtering on the speech signal by using a first set of pre-augmented filter coefficients associated with a first user group, to obtain a pre-augmented speech signal;

when the set of feature characteristics matches a second set of predefined features, performing pre-augmented filtering on the speech signal by using a second set of pre-augmented filter coefficients that is different from the first set of pre-augmented filter coefficients and associated with a second user group that is different from the first user group, to obtain the pre-augmented speech signal, wherein the first set of pre-augmented filter coefficients boosts energy proportions of medium-high frequency of the speech signal more than the second set of pre-augmented filter coefficients does to the speech signal;

performing cascade encoding/decoding to the pre-augmented speech signal to generate an augmented speech signal;

processing the augmented speech signal using a first audio codec of the first terminal; and transmitting the processed augmented speech signal to a second terminal via a voice communication channel, wherein the second terminal processes the processed augmented speech signal using a second audio codec that is different from the first audio codec and then plays the augmented speech signal to a user of the second terminal.

14. The non-transitory computer readable storage medium according to claim 13, wherein the plurality of operations further comprise:

performing offline training according to a training sample in an audio training set to obtain the first set of pre-augmented filter coefficients and the second set of pre-augmented filter coefficients, comprising:

obtaining a sample speech signal from the audio training set, wherein the sample speech signal is a first feature sample speech signal or a second feature sample speech signal;

performing simulated cascade encoding/decoding on the sample speech signal, to obtain a degraded speech signal;

obtaining energy attenuation values between the degraded speech signal and the sample speech signal corresponding to different frequencies, and using the energy attenuation values as frequency energy compensation values;

averaging frequency energy compensation values corresponding to the first feature signal in the audio training set to obtain an average energy compensation value of the first feature signal at different frequencies, and averaging frequency energy compensation values corresponding to the second feature signal in the audio training set to obtain an average energy compensation value of the second feature signal at different frequencies; and performing filter fitting according to the average energy compensation value of the first feature signal at different frequencies to obtain a first pre-augmented filter coefficient, and performing filter fitting according to the average energy compensation value of the second feature signal at different frequencies to obtain a second pre-augmented filter coefficient.

15. The non-transitory computer readable storage medium according to claim 13, wherein the performing feature recognition on the speech signal comprises:

obtaining a pitch period of the speech signal; and determining whether the pitch period of the speech signal is greater than a preset period value, wherein if the pitch period of the speech signal is greater than the preset period value, the speech signal is a first feature signal; otherwise, the speech signal is a second feature signal.

16. The non-transitory computer readable storage medium according to claim 15, wherein the obtaining a pitch period of the speech signal comprises:

translating and framing the speech signal by using a rectangular window, wherein a window length of each frame is a first quantity of sampling points, and each frame is translated by a second quantity of sampling points;

performing tri-level clipping on each frame of the signal;

calculating an autocorrelation value for a sampling point in each frame; and using a sequence number corresponding to a maximum autocorrelation value in each frame as a pitch period of the frame.

17. The non-transitory computer readable storage medium according to claim 16, wherein before the translating and framing the speech signal by using a rectangular window, wherein a window length of each frame is a first quantity of sampling points, and each frame is translated by a second quantity of sampling points, the obtaining a pitch period of the speech signal further comprises:

performing band-pass filtering on the speech signal; and performing pre-emphasis on the band-pass filtered speech signal.

18. The non-transitory computer readable storage medium according to claim 13, wherein the plurality of operations further comprise:

obtaining an original audio signal;

dividing the original audio signal into the speech signal and a non-speech signal; and performing high-pass filtering on the non-speech signal.

* * * * *